US006269935B1

(12) United States Patent
McCullen et al.

(10) Patent No.: US 6,269,935 B1
(45) Date of Patent: Aug. 7, 2001

(54) HIGH SPEED CAP APPLICATOR CAP HOLDER

(75) Inventors: David R. McCullen, Howell; Richard J. Koss, Highland, both of MI (US)

(73) Assignee: Elopak Systems AG, Glattbrugg (CH)

( * ) Notice: Subject to any disclaimer, the term of this patent is extended or adjusted under 35 U.S.C. 154(b) by 0 days.

(21) Appl. No.: 09/359,493

(22) Filed: Jul. 23, 1999

(51) Int. Cl.[7] ..... B65H 25/00; B65H 29/00; B65H 32/00; B65H 47/84

(52) U.S. Cl. ..... 198/470.1

(58) Field of Search ..... 271/306, 277, 271/3.24; 198/470.1, 644; 101/409; 493/87, 135, 133; 156/379.8, 273.3, 309.9, 320, 322, 380.9, 499; 229/125.04; 220/258, 259; 222/541.5, 560

(56) References Cited

U.S. PATENT DOCUMENTS

| | | | |
|---|---|---|---|
| 4,507,168 | 3/1985 | Konaka . | |
| 4,788,811 | 12/1988 | Kawajiri et al. . | |
| 4,925,034 | 5/1990 | Robichaud et al. . | |
| 5,088,643 | 2/1992 | Frazier et al. . | |
| 5,100,369 | 3/1992 | Keeler . | |
| 5,101,999 | 4/1992 | Robichaud et al. . | |
| 5,102,485 | 4/1992 | Keeler et al. . | |
| 5,110,041 | 5/1992 | Keeler . | |
| 5,366,433 * | 11/1994 | McCormick | 493/38 |
| 5,653,832 * | 8/1997 | Thompson et al. | 156/73.1 |
| 5,716,471 | 2/1998 | Pape . | |
| 5,964,687 * | 10/1999 | Rogalski et al. | 493/102 |
| 6,094,884 * | 8/2000 | Christiansen et al. | 53/375.9 |

* cited by examiner

*Primary Examiner*—Christopher P. Ellis
*Assistant Examiner*—Kenneth W Bower
(74) *Attorney, Agent, or Firm*—Reising, Ethington, Barnes, Kisselle, Learman & McCulloch, P.C.

(57) ABSTRACT

A holder for picking up and holding a fitment and cap assembly prior to the bonding thereof on a filled and sealed carton. The holder is one of a plurality of holders mounted on a continuously moving conveyor. Each holder includes a body having an arcuate surface for engagement of the cap portion of the fitment and cap assembly, an arm pivotally mounted on the body, a compression spring mounted in an opening formed in the body and abutting against an inner end of the arm, and a pair of spaced abutments formed on the inner surface of the outer end for engaging vertical ribs formed on the cap adjacent the arcuate surface of the holder body.

16 Claims, 3 Drawing Sheets

HIGH SPEED CAP APPLICATOR CAP HOLDER

BACKGROUND OF THE DISCLOSURE

1. Technical Field

This invention relates primarily to methods and apparati for securing articles to laminates and, more particularly, to an improved article holder therefor.

2. Background of the Invention

Heretofore, flanged pour spout fitment type articles have been secured to thermoplastic-coated container panels in two manners, namely, with the article thereof either (1) inserted into an open top container such that the flange thereof is secured to the inner surface of a selected panel around a dispensing opening with the body thereof extended outwardly through the opening, or (2) mounted on a filled and sealed container to the outer surface of the panel around an opening or partially cut-through potential opening.

With regard to the latter manner, Frazier et al U.S. Pat. No. 5,088,643 states that "the pour spout fitment is preferably adhered to the outer surface of the container panel by impulse heating under pressure such as ultrasonic sealing although other methods may be used as desired."

Robichaud et al U.S. Pat. No. 4,925,034 discloses adhesively bonding a pour spout fitment by a hot melt glue to a top outer surface of a container.

Robichaud et al U.S. Pat. No. 5,101,999 suggests that a spout or closure be "attached to the package top by any suitable means such as an adhesive applied to a bottom surface of the closure to be attached to the package top." Where the package is coated with an outer thermoplastic layer of polyethylene, which discourages such adhesion, Robishaud et al disclose perimeter cuts which may be serrated or applied as perforated cuts. Such serrations or perforated cuts need only penetrate the polyethylene outer layer to allow the adhesive to bond with the underlying carrier or paper layer.

Pape U.S. Pat. No. 5,716,471 discloses a method for securing a pour spout fitment to a thermoplastic-coated paperboard carton, wherein the pour spout fitment is heated remotely by a suitable heating mechanism, to a predetermined temperature, such that, when the fitment is applied to a selected outer surface of a thermoplastic-coated carton, the heat is transferred to the latter surface at a temperature capable of activating the thermoplastic coating. Upon cooling, the fitment and the carton surface bond together. In this arrangement, the erected or formed carton provides a box type support, capable of being subjected to the bonding pressure involved, without the need for a mandrel or anvil back-up, as previously used to withstand the sealing pressures required.

Keeler U.S. Pat. No. 5,110,041 discloses an in-line fitment sealing apparatus and method for attaching a fitment to the outer surface of a panel of a carton blank assembled in rectangular tube configuration, requiring anvil means movable into the open top end of a carton to abut against an internal wall adjacent the spout position.

Keeler et al U.S. Pat. No. 5,102,485 discloses a transfer drum which receives fitments from a fitment breaking-cylinder acting on a web at four equidistant peripheral stations, during dwells of the drum. While the drum is then rotated through each 90° segment, each fitment is pressed onto a carton blank in a continuous synchronized movement with the conveyor carrying the blanks.

DISCLOSURE OF THE INVENTION

A general object of the invention is to provide an improved pour spout fitment holder for efficiently picking up, holding and then releasing a fitment during continuous, non-dwell, movements of both a carton and the holder.

Another object of the invention is to provide a plurality of improved holders adaptable for picking up and transferring through heating and bonding steps fitment and cap assemblies released one-at-a-time from an escapement device, during a high speed, continuously moving operation of applying fitment and cap assemblies to cartons.

A further object of the invention is to provide such an improved holder including a spring-loaded pivot arm which securely grips a fitment and cap assembly without any possibility of an associated enclosed compression spring becoming warped and thus inefficient.

These and other objects and advantages will become more apparent when reference is made to the following drawings and accompanying description.

BEST MODE OF CARRYING OUT THE INVENTION

Figure 1:
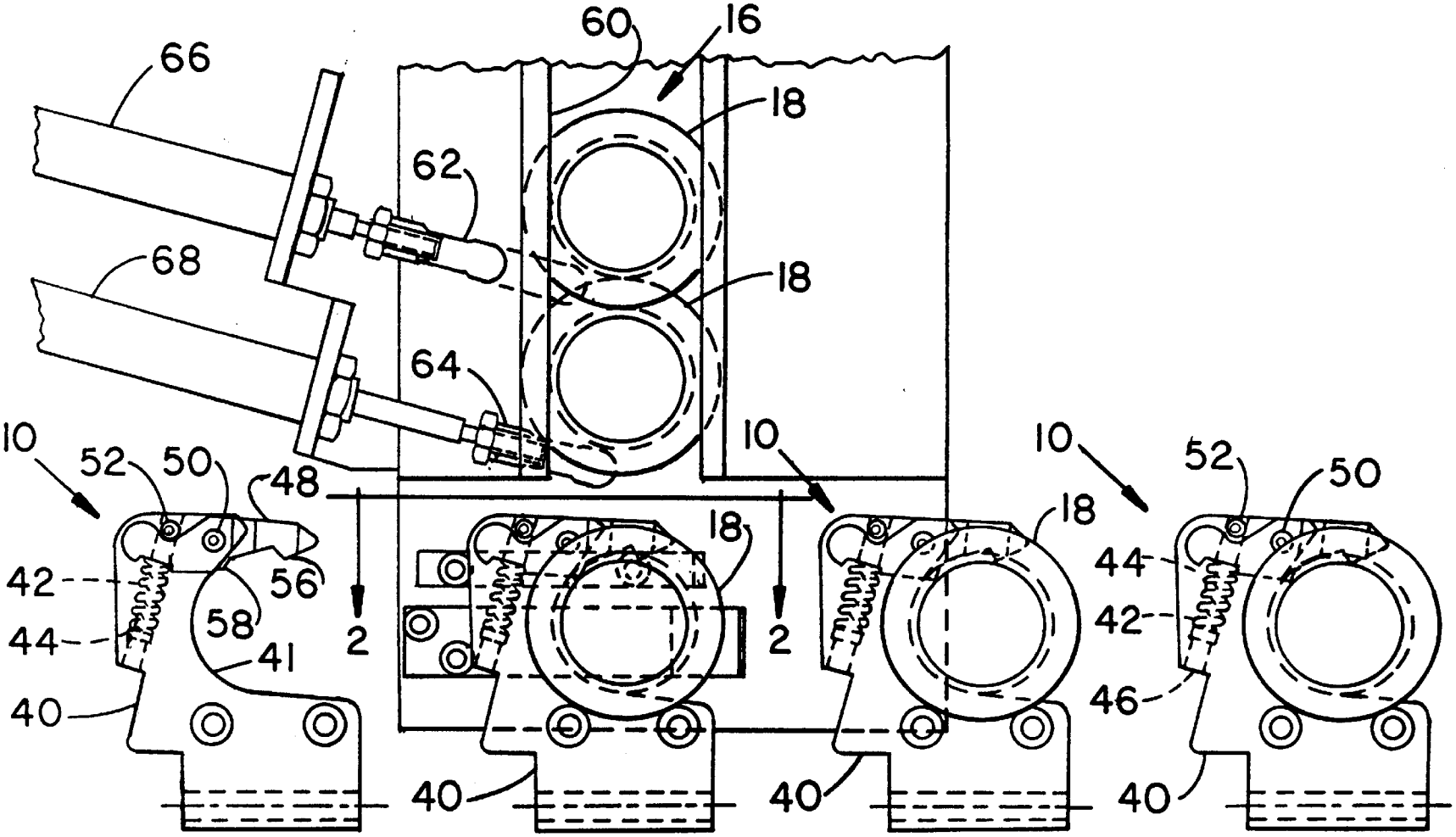
FIG. 1 is an enlarged fragmentary portion of a fitment applicator machine showing a side view of a plurality of the inventive fitment holders in operation.
Figure 2:
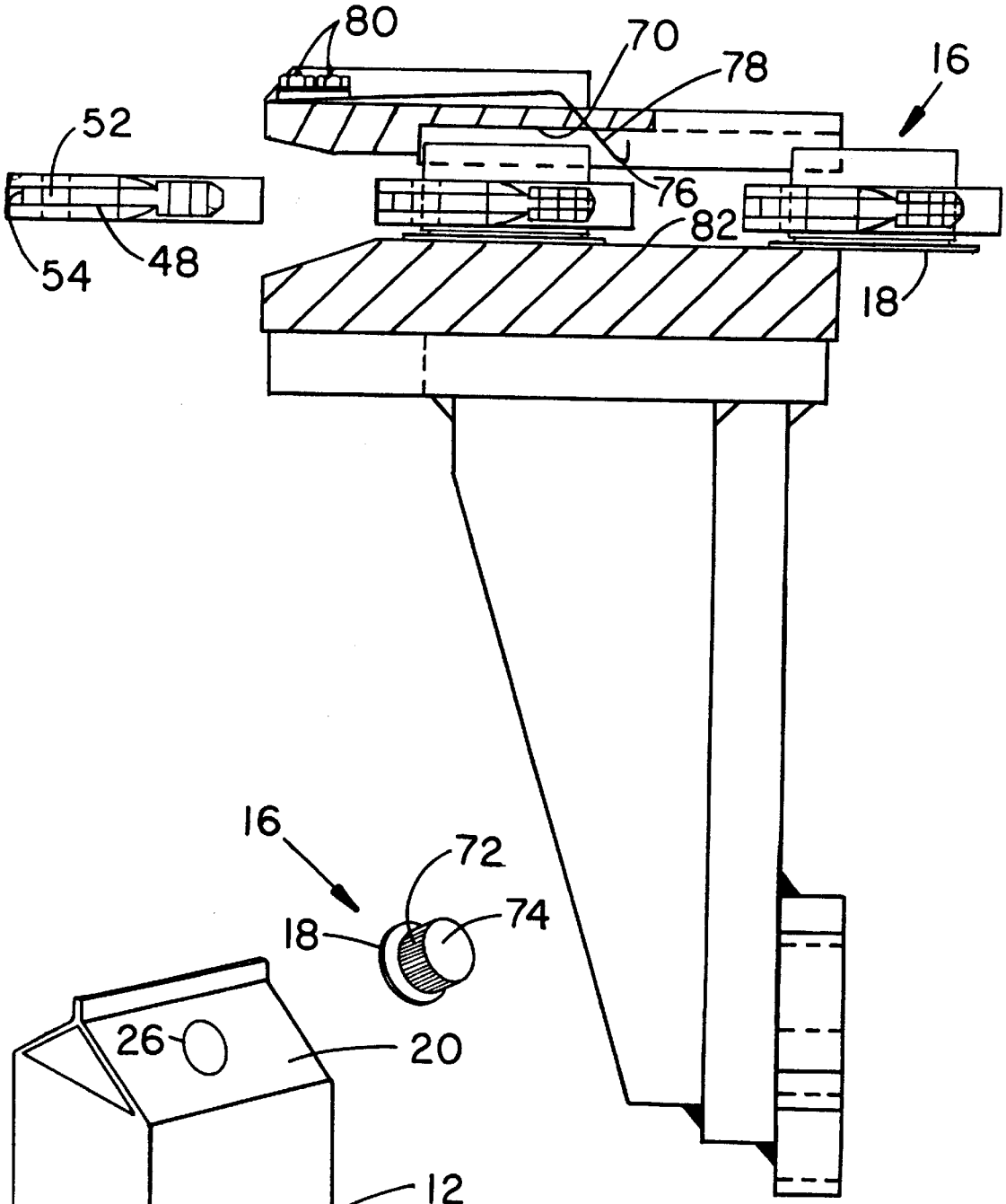
FIG. 2 is a cross-sectional view taken along the plane of the line 2—2 of FIG. 1, and looking in the direction of the arrows.

Referring now to the drawings in greater detail, FIG. 1 shows a holder 10 for use on a continuously moving fitment and cap applicator machine (not shown), such as the Elopak, Inc. Model PAS70. The cap applicator machine is mounted adjacent a conveyor extending from a conventional and well known carton forming, filling and sealing machine, such as the machine.

Figure 6:
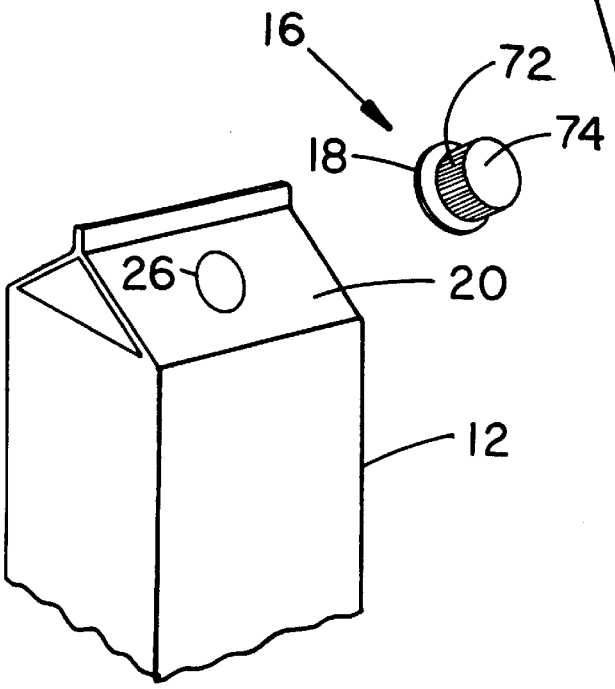
FIG. 6 is a perspective fragmentary view of a filled and sealed gable top carton and a pour spout fitment and cap assembly aligned for mounting thereon.

On a machine such as the PAS70, as filled and sealed cartons 12 exit from a filling and sealing machine along an extended conveyor, they are diverted by rails to a conveyor of the fitment and cap applicator machine. A brake arrangement on a cross-over conveyor serves to control that a predetermined number of filled cartons 12 (FIG. 6) are initially aligned longitudinally prior to entering the applicator machine's carton conveyor. Thereafter, the pressure of the oncoming cartons 12 is sufficient to assure that each carton will load properly at a carton loader position and move non-stop thereafter.

A carton loader includes a carton pusher which serves to push each lead carton 12 laterally into a pocket formed by spaced apart lugs on a separate carton conveyor, just prior to the carton becoming confined by oppositely disposed pairs of lugs.

Figure 3:
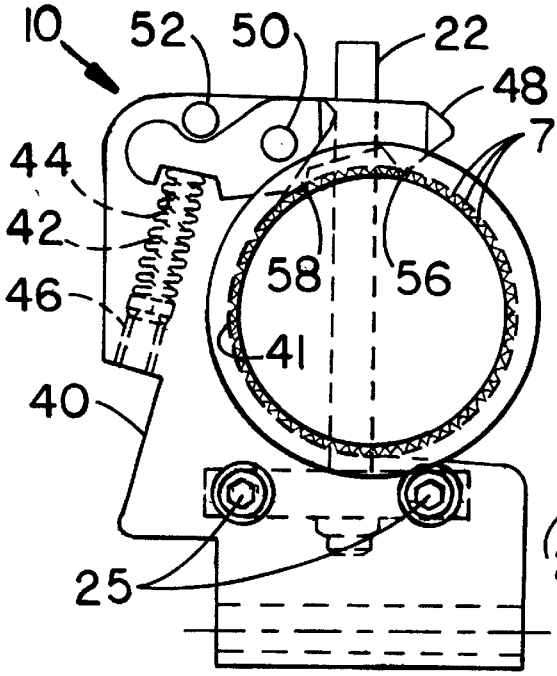
FIG. 3 is an enlarged side view of one of the holders of FIG. 1.
Figure 5:
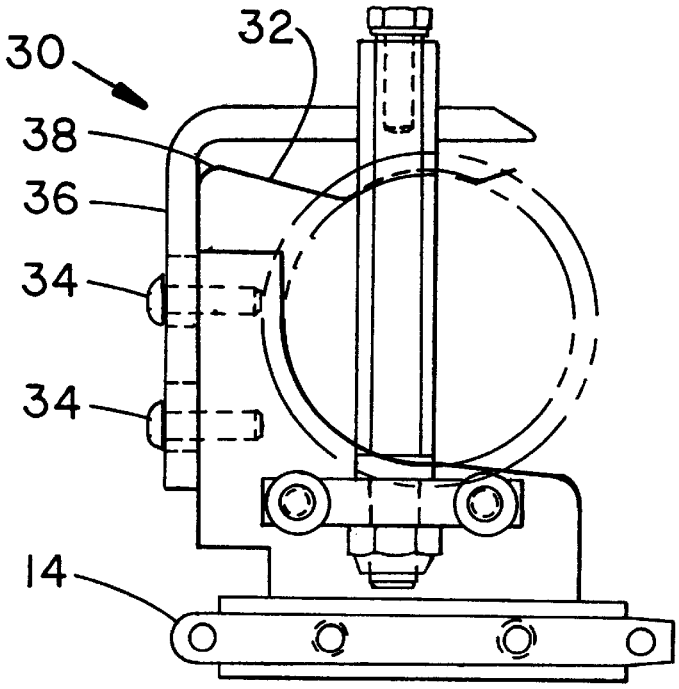
PRIOR ART FIG. 5
FIG. 5 is a side view of the prior art fitment holder.

A further holder conveyor, represented generally at 14 in FIG. 5, is positioned directly above the lugged carton conveyor. A predetermined number of cap holders 10, for example 43 in number, are pivotally mounted on the holder conveyor 14 and move in a timed relationship with the cartons 12 being conveyed directly therebelow. As may be determined from FIG. 3, each holder 10 is adapted to be pivotally mounted in any suitable manner on the conveyor 14.

Referring once again to FIG. 1, once a pour spout fitment and cap assembly 16 is picked up by the holder 10, in a manner to be described, the continuously moving conveyor 14, as well as the above referenced carton conveyor pass beneath a heater which serves to heat both the exposed flange 18 surface of the fitment and cap assembly 16 and the sloped panel 20 surface (FIG. 6) of the gable top carton 12.

Figure 4:
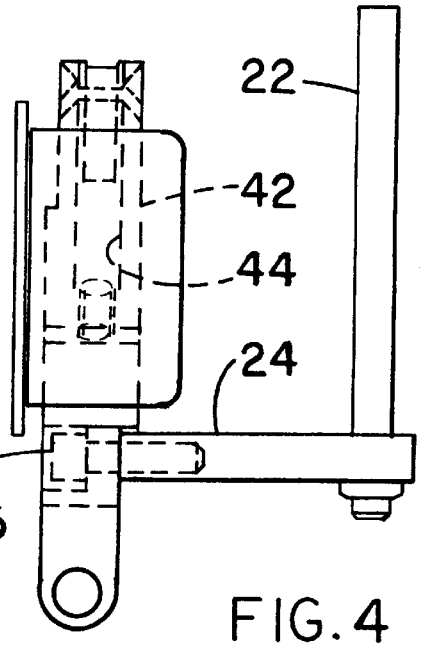
FIG. 4 is an end view of the FIG. 3 structure.

After both surfaces have been heated, a stem 22 (FIG. 4), on a bracket 24 secured by fasteners 25 to the holder 10, is cammed downwardly by suitable cam means, such that the assembly 16 in the holder is forced under a water cooled pressure rail at the same angle as the angle of the sloped panel 20, and in contact with the latter. This engagement under pressure between the heated flange 18 and the heated panel 20, in registration with a partial cut circle or an opening, shown as 26 in FIG. 6, completes the bonding of the assembly 16 to the carton 12. Whether a partial cut or full opening is formed in the carton panel 20 depends upon the type of fitment and cap assembly 16 being used. If not a full opening 26, a partial cut circle would serve as a slug to be broken loose and retained by a heated internal extension of a selected fitment and cap assembly 16.

After the bonding operation, the carton 12 and the fitment and cap assembly 16 are diverted from the ends of their respective vertically oriented conveyors back onto the above referenced conveyor extending from the carton forming, filling and sealing machine.

Referring now to FIG. 5, the prior art fitment holder 30 initially in use on the PAS70 machine is shown to include a shaped leaf spring 32 secured by screws 34 to a spring guard 36. It was found that, through continued production use thereof, the exposure of the spring 32 to the heater which, as described above, serves to heat both the flange 18 and the panel 20, was prone to cause the spring 32 to deform at its bend 38 and occasionally allow a fitment and cap assembly 16 to drop out and thus interrupt production.

Such a possible production problem is solved by the cap holder 10 shown in FIGS. 1–4. More specifically, the holder 10 includes a body 40 having an inner arcuate surface 41, and a compression spring 42 mounted in an opening 44, with an adjusting screw 46 threadedly mounted at the end of the opening 44. The innermost end of the spring 42 abuts against a pivot arm 48 pivotally mounted around a pivot pin 50 secured through the body 40. A further pin 52 through the body 42 serves as a stop pin adjacent the rear end 54 of the pivot arm 48. A pair of spaced protrusions 56 and 58 (FIG. 3) are formed on the inner surface of the pivot arm 48 for a purpose to be described.

As shown in FIG. 1, a row of fitment and cap assemblies 16 are stacked in a track 60 extending downwardly from a convention parts feeder unit (not shown), which receives small parts, such as the assemblies 16, from a hopper and orients them for feeding into the track 60.

At the bottom exit end of the track 60 a pair of cap entrapment pins 62 and 64, driven by respective cylinders 66 and 68, serve to alternately release the bottommost fitment and cap assembly 16 by retracting the pin 64, while retaining the next to last assembly by the pin 62, and then allowing the stack to drop one position as the pins alternate positions.

The released assembly 16 drops into a receiver assembly 70 (FIG. 2) just prior to the arrival of a continuously moving holder 10. As shown in FIG. 1, the holder 10 picks up the assembly 16 against the arcuate surface 41, with the protrusions 56 and 58 extending into vertical slots 72 (FIGS. 3 and 6) formed on the cap portion 74 of each assembly 16, resulting from the settling movement of the pivot arm 48 against the force of the compression spring 42.

As the holder 10 continues its forward motion, the distal end 76 of an alignment spring 78 (FIG. 2), secured by screws 80 on a surface of the receiver assembly 70, causes the flange 18 of the fitment and cap assembly 16 to seat and slide flush against a machined side wall surface 82 of the receiver assembly 70.

Industrial Applicability

It should be evident that the improved inventive holders with their enclosed compression spring and the associated pivot arm eliminate the possibility of possible dropping of the fitment and cap assemblies due to spring warpage resulting from a spring being heated, that could interrupt the high speed production of a continuously moving, non-dwell type of machine which bonds fitment and cap assemblies to filled and sealed cartons.

It should be further apparent that the improved holders 10 can readily replace the prior art holders 30 on fitment and cap applicator machines.

It should be still further apparent that the improved holder could supply fitment and cap assemblies to other carton shapes, such as vertical or flat top configurations.

While but one general embodiment of the invention has been shown and described, other modifications thereof are possible within the scope of the following claims.

What is claimed is:

1. For use with a continuously moving carton conveyor carrying cartons confined between lugs, an escapement mechanism adapted to release one fitment and cap assembly at a time, and an open-ended receiver assembly adapted to receive individual fitment and cap assemblies from the escapement mechanism, a plurality of spaced holders mounted on a continuously moving conveyor directly above and in registration with the carton conveyor, each said holder including a body adapted to pick up from said receiver assembly and hold a fitment and cap assembly while selected surfaces of both the latter assembly and the carton are heated and until said heated assembly surface is placed on said heated carton surface to become bonded thereto, characterized by a pivot arm pivotally mounted on a pivot pin in said body, and an enclosed compression spring for loading said pivot pin against said fitment and cap assembly in the holder.

2. The holder described in claim 1, wherein said body includes an arcuate surface for engaging the fitment and cap assembly.

3. The holder described in claim 1, and a pair of protrusions formed on an inner surface of said pivot arm for accurately gripping and fixedly securing the cap of said fitment and cap assembly within said holder.

4. The holder described in claim 1, and an opening formed in said holder, said compression spring being adjustably retained in said opening by an adjusting screw.

5. The holder described in claim 1, and a stop pin mounted in said body for stopping said pivot arm under the force of said compression spring when no fitment and cap assembly is being picked up and held by the holder.

6. The holder described in claim 1, and including pivot and extended stem means adapted to cooperate with external means for pivoting the holder into a predetermined selected angle for bonding to a selected carton surface during the holder's continuous movement.

7. Apparatus for use in applying fitments to packaging material comprising:

a fitment holder including a fitment support and retaining device arranged to retain elastically and releasably a fitment on said support, and a heater arranged to heat a thermoplastic surface portion of said fitment while said fitment is retained in said holder by said retaining means, said retaining means comprising a first portion arranged to be applied to said fitment and an elastic second portion carried by said support and arranged to urge said first portion in a direction towards said fitment, said retaining means being discontinuous between the first and second portions, such that thermal conduction between the first and second portions is inhibited.

8. Apparatus according to claim 7, wherein said second portion is shielded by said support against heat emitted by said heater.

9. Apparatus according to claim 7, wherein said first portion is inelastic.

10. Apparatus according to claim 7, wherein said first portion comprises an arm pivotally mounted upon said support and said second portion comprises a coil spring.

11. Apparatus according to claim 10, wherein said first portion is a two-armed lever including said arm and said second portion acts turningly upon the other arm of said lever.

12. Apparatus according to claim 10, wherein said spring is a compression spring.

13. Apparatus according to claim 10, wherein said holder further comprises adjusting means for adjusting said spring.

14. Apparatus according to claim 7, wherein said holder further comprises an abutment carried by said support and arranged to limit movement of said first portion of said retaining device said direction.

15. Apparatus according to claim 7, wherein said first portion comprises first and second teeth for locatingly engaging a peripheral surface of a fitment.

16. Apparatus comprising:

a fitment conveyor including a series of fitment holders, each fitment holder including a fitment support and retaining means arranged to retain elastically and releasably a fitment on said support, each retaining device comprising a first portion arranged to be applied to said fitment and an elastic second portion carried by said support and arranged to urge said first portion in a direction towards said fitment, and a heater arranged to heat respective thermoplastic surface portions of said fitments while said fitments are retained in their respective holders by the respective retaining means, each retaining means being discontinuous between its first and second portions.

* * * * *